US010655639B2

(12) United States Patent
Chang et al.

(10) Patent No.: US 10,655,639 B2
(45) Date of Patent: May 19, 2020

(54) BALANCE STRUCTURE OF FAN ROTOR

(71) Applicant: ASIA VITAL COMPONENTS CO., LTD., New Taipei (TW)

(72) Inventors: Bor-Haw Chang, New Taipei (TW); Chung-Shu Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 138 days.

(21) Appl. No.: 15/905,725

(22) Filed: Feb. 26, 2018

(65) Prior Publication Data

US 2019/0264709 A1 Aug. 29, 2019

(51) Int. Cl.
*F04D 29/66* (2006.01)

(52) U.S. Cl.
CPC ..... *F04D 29/662* (2013.01)

(58) Field of Classification Search
CPC ..... F04D 29/662; G01M 1/36; G01M 1/30
See application file for complete search history.

(56) References Cited

U.S. PATENT DOCUMENTS 7,063,507 B2 * 6/2006 Hsieh ..... F04D 29/662 415/119
8,721,266 B2 * 5/2014 Chang ..... F04D 29/662 415/119
2005/0249596 A1 * 11/2005 Hsieh ..... F04D 29/662 416/144
2012/0107120 A1 * 5/2012 Chang ..... F04D 29/329 416/145

* cited by examiner

*Primary Examiner* — Eldon T Brockman
(74) *Attorney, Agent, or Firm* — Demian K. Jackson; Jackson IPG PLLC

(57) ABSTRACT

The present invention relates to a balance structure of a fan rotor, which comprises a fan wheel and a balancing part. The fan wheel has a hub and a plurality of blades disposed on the circumferential side of the hub. The hub has a top wall connected to a sidewall. An unbalanced portion is selectively disposed on the top wall or on the sidewall. The unbalanced portion is disposed on one side of a symmetrical axis of the hub. The balancing part is disposed at the unbalanced portion such that the fan rotor is balanced.

10 Claims, 8 Drawing Sheets

BALANCE STRUCTURE OF FAN ROTOR

BACKGROUND OF THE INVENTION

Field of the Invention

The present invention relates to a balance structure of a fan rotor and, in particular, to a balance structure of a fan rotor, which achieves the effects of balancing the rotor quickly and reducing the cost.

Description of Prior Art

With the development of the computer technology, the operating frequencies and the performances of the components inside the computers increase and thus the power consumption and the heat generation of components inside the computers increase accordingly. In order to reduce the temperature inside the PC case and dissipate the generated heat, a heat-dissipating mechanism with a high performance is required to help remove the heat generated from the components inside the PC case to keep the interior of the PC case from remaining in a high temperature state which further affects the lifetimes of the internal components or causes unstable operation. In the field of heat dissipation for the computer system, the mainstream of computer cooling technique commonly used in the industry is a combined heat-dissipating system including the fan and the heat-dissipating fin. The fan, which is an axial fan, a centrifugal fan, or a mixed flow fan, is always equipped with the heat-dissipating fin as a main choice to resolve the issue of system over-temperature or help remove the heat generated from the internal components.

The principle of wind generation by the fan is nothing more than through the shape design of the blades on the rotor and the drives of the motor and the circuit board to make the rotor rotate at the rated speed such that the air flows through the rotating designed blades to thrust to generate the wind. Besides, the rotating component (i.e., the rotor) achieves a smooth rotation by the calibration of a fan rotor balancing machine to prevent the undesired vibration that induces noise and affects the fan structure to decrease the lifetime of the fan. As for a traditional fan, the smaller the fan size is, the more important the vibration requirements of the fan become. When the fan is compact and lightweight, the vibration requirements of the fan are tough. Thus, the balancing process is extremely hard. Also, it is usually difficult to control an adequate amount (e.g., milligrams) of balancing clay and the balancing process needs to be repeated to converge to meet the requirements. Therefore, the balancing process of calibrating the rotor takes much more time to obtain a better balancing quality. Besides, more work force and balancing equipment are required to maintain a substantial capacity, which causes higher production cost and excessive working hours for the balancing.

The current operation of the balancing and calibration process regarding the rotor is still performed manually. The workers perform manual weight addition (i.e., balance by compensation) or manual weight reduction (i.e., balance by reduction) according to the approximate test result and the position of an unbalance point projected by a light on the rotor. For example, the worker looks at the approximate position of the unbalance point projected on the rotor and then takes the whole rotor out and away from the fan rotor balancing machine for balance compensation. At this time, the position of the unbalance point projected previously on the rotor does not exist any longer and only can be recognized by the worker's sight and memory for adding weight or reducing weight of the rotor. Therefore, the completion of the balancing and calibration process regarding the rotor needs repeated tests and weight addition/reduction processes. As a result, the production yield rate decreases and the balancing accuracy is not high.

SUMMARY OF THE INVENTION

One objective of the present invention is to provide a balance structure of a fan rotor, which achieves quick balancing of the fan rotor and the cost reduction.

Another objective of the present invention is to provide a balance structure of a fan rotor, which effectively reduces the number of balancing repetition and decreases the working hours for the balancing process by means of an unbalanced portion. The unbalanced portion is integrally formed and selectively disposed on the top wall or on the sidewall of the hub and disposed on one side of a symmetrical axis of the hub such that an accurate amount of balancing clay can be obtained to fill into the unbalanced portion to balance the fan rotor to balance the fan rotor.

To achieve the above objectives, the present invention provides a balance structure of a fan rotor, which comprises a fan wheel and a balancing part. The fan wheel has a hub and a plurality of blades disposed on the circumferential side of the hub. The hub has a top wall connected to a sidewall. An unbalanced portion is selectively disposed on the top wall or on the sidewall. The unbalanced portion is disposed on one side of a symmetrical axis of the hub. The balancing part is disposed at the unbalanced portion such that the fan rotor is balanced. By means of the design of the balance structure of the present invention, the production cost and the working hours can be effectively reduced and the effect of quick balancing the fan rotor can be achieved.

DETAILED DESCRIPTION OF THE INVENTION

The above objective, structural and functional characteristics of the present invention will be described according to the preferred embodiments with the accompanying figures.

Figure 1:
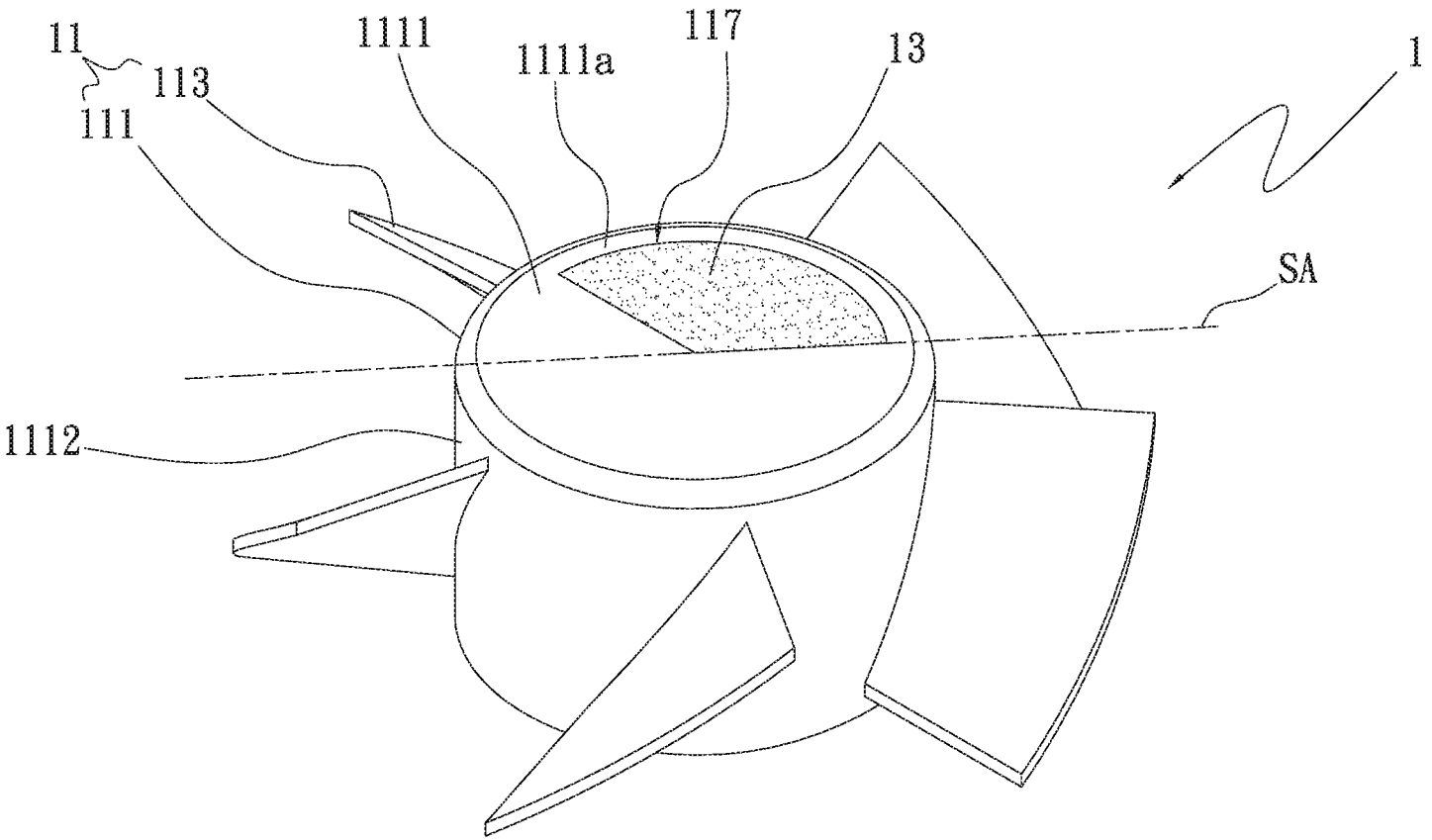
FIG. 1 is a perspective assembled view of the unbalanced portion of the rotor according to the first embodiment of the present invention.
Figure 2:
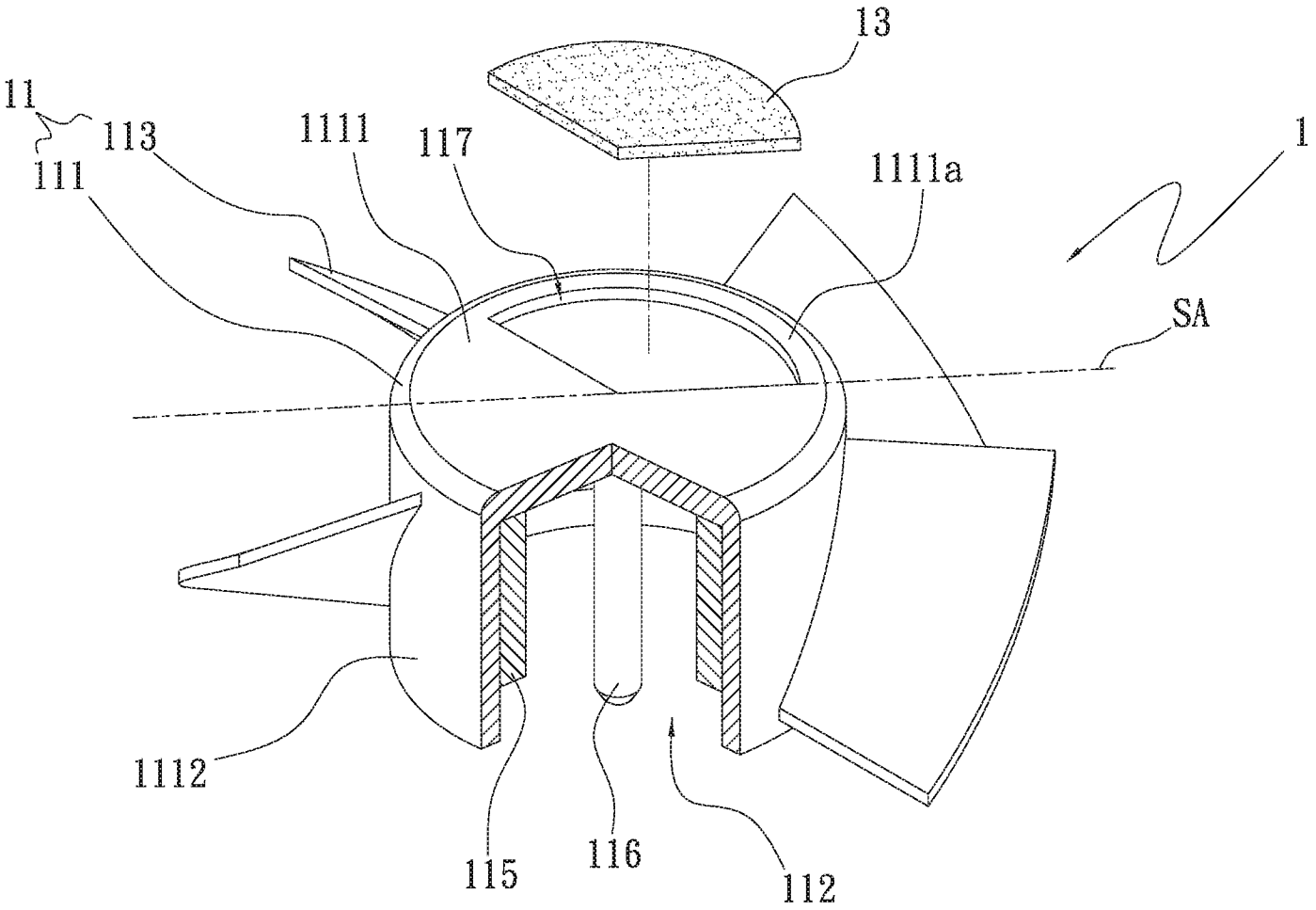
FIG. 2 is a perspective exploded and local cross-sectional view of the unbalanced portion of the rotor according to the first embodiment of the present invention.

The present invention relates to a balance structure of a fan rotor. FIG. 1 is a perspective assembled view of the unbalanced portion of the rotor according to the first embodiment of the present invention. FIG. 2 is a perspective exploded and local cross-sectional view of the unbalanced portion of the rotor according to the first embodiment of the present invention. As shown in FIGS. 1 and 2. The balance structure of a fan rotor 1 of the present invention comprises a fan wheel 11 and a balanced part 13. In the current embodiment, the fan wheel 11 is made of plastic, but not limited to this. In other practices, the fan wheel 11 can also be made of metal. The fan wheel 11 has a hub 111, a magnetic part 115, an axial shaft 116, and a plurality of blades 113. The blades 113 are encirclingly disposed on the circumferential side of the hub 111. The hub 111 has a top wall 1111 connected to a sidewall 1112. One end of the sidewall 1112 is connected to the outer edge of the top wall 1111. The receiving space 112 is defined by the top wall 1111 and the sidewall 1112. The magnetic part 115 is a magnet received and disposed on an inner side of the sidewall 1112 of the receiving space 112. The axial shaft 116 is inserted in the receiving space 112, at the center of the inner side of the top wall 1111 of the hub 111. The unbalanced portion 117 is selectively disposed on the top wall 1111 or on the sidewall 1112; the unbalanced portion 117 is located on one side or on the other side of the symmetrical axis SA of the hub 111. The current embodiment, when in practice, uses an injection mold (e.g., a plastic injection mold; not shown) having an unbalanced portion 117 like a recessed groove which is located on one side (or the other side) of the symmetrical axis SA of the hub 111 of the fan wheel 11 to be injected. Then, the above-mentioned unbalanced portion 117 is integrally injected and formed on the top wall 1111 or on the sidewall 1112 of the hub 111 of the fan wheel 11 by means of the injection mold.

Please continue to refer to FIG. 1 which is a perspective assembled view of the unbalanced portion of the rotor according to the first embodiment of the present invention and FIG. 2 which is a perspective exploded view of the unbalanced portion of the rotor according to the first embodiment of the present invention. As shown in FIGS. 1 and 2, the unbalanced portion 117 of the present invention is a recessed groove and has a circular sector shape. In the current embodiment, the unbalanced portion 117 is integrally formed and recessed on the external surface 1111*a* of the top wall 1111 of the hub 111 by means of the above-mentioned injection mold; the unbalanced portion 117 is located on one side of the symmetrical axis SA of the hub 111. The external surface 1111*a* of the top wall 1111 of the hub 111 located on one side of the symmetrical axis SA of the hub 111 and the external surface 1111*a* of the top wall 1111 of the hub 111 located on the other side of the symmetrical axis SA of the hub 111 are not symmetrical to each other. That is, the external surfaces 1111*a* of the top wall 1111 of the hub 111 located on one side and on the other side of the symmetrical axis SA of the hub 111 indicate a non-symmetrical design in which the symmetrical axis SA of the hub 111 is a virtual line that is vertical to the surface of the sidewall 1112 and passes through the center of the hub 111.

The above-mentioned balancing part 13 is a balancing clay which is disposed in the unbalanced portion 117. Also, the shape of the balancing part 13 matches that of the unbalanced portion 117. For example, the balancing part 13 having a circular sector shape can be directly placed in the corresponding circular sector shape formed in the unbalanced portion 117 such that the top side of the balancing part 13 is flush with the external surface 1111*a* of the top wall 1111 of the hub 111 to achieve quick balancing of the fan rotor. In addition, because the fan wheel 11 is injected and formed by means of the injection mold, the worker can preset and know in advance the amount of weight reduction, the structure type (e.g., a recessed groove structure), and the shape (e.g., a square or others) of the unbalanced portion 117 on the hub 111 of the fan wheel 11 to be injected and formed. Therefore, the worker can directly take a balancing part 13 which has been weighed, as heavy as the removed unbalanced portion 117, and then place it in the unbalanced portion 117 to achieve the purpose of quick balancing and operating of the fan rotor. For example, the worker knows, from the display screen of the injection mold machine (e.g., an LCD screen; not shown), that the removed weight of the unbalanced portion 117 (as a recessed groove, which is preset and injected) of the hub 111 of the fan wheel 11 is 6.003 g. Then, the worker directly takes a balancing clay (i.e., the balancing part 13) which has been weighed to be as heavy as the removed weight of the unbalanced portion 117, 6.003 g, and places it in the recessed groove. In this way, the worker can complete the balancing process of the fan rotor (or the material-adding balancing process of the fan rotor) at one time, which effectively reduces the working hours and the material of the balancing part. Besides, because the accurate weight of the balancing part 13 can be obtained with specific compensation amounts by means of the present invention, the mass production of the balancing parts 13 with customized compensation amounts (e.g., customized balancing clay with the compensation amount of 6.003 g or other weights) is feasible. Accordingly, the balancing process can be effectively accelerated and the required vibration requirements can be achieved to further decrease the number of the balancing processes.

Therefore, by means of the integrally-formed structure of the unbalanced portion (e.g., the recessed groove) on the hub 111 of the fan wheel 11, the unbalance amount of the whole injected-formed fan wheel 11 certainly falls within the unbalanced portion 117, which lets the worker directly know the position for balance compensation and the weight of the balancing clay to be placed to effectively achieve the effect of quick balancing of the fan rotor and the cost reduction.

Figure 3A:
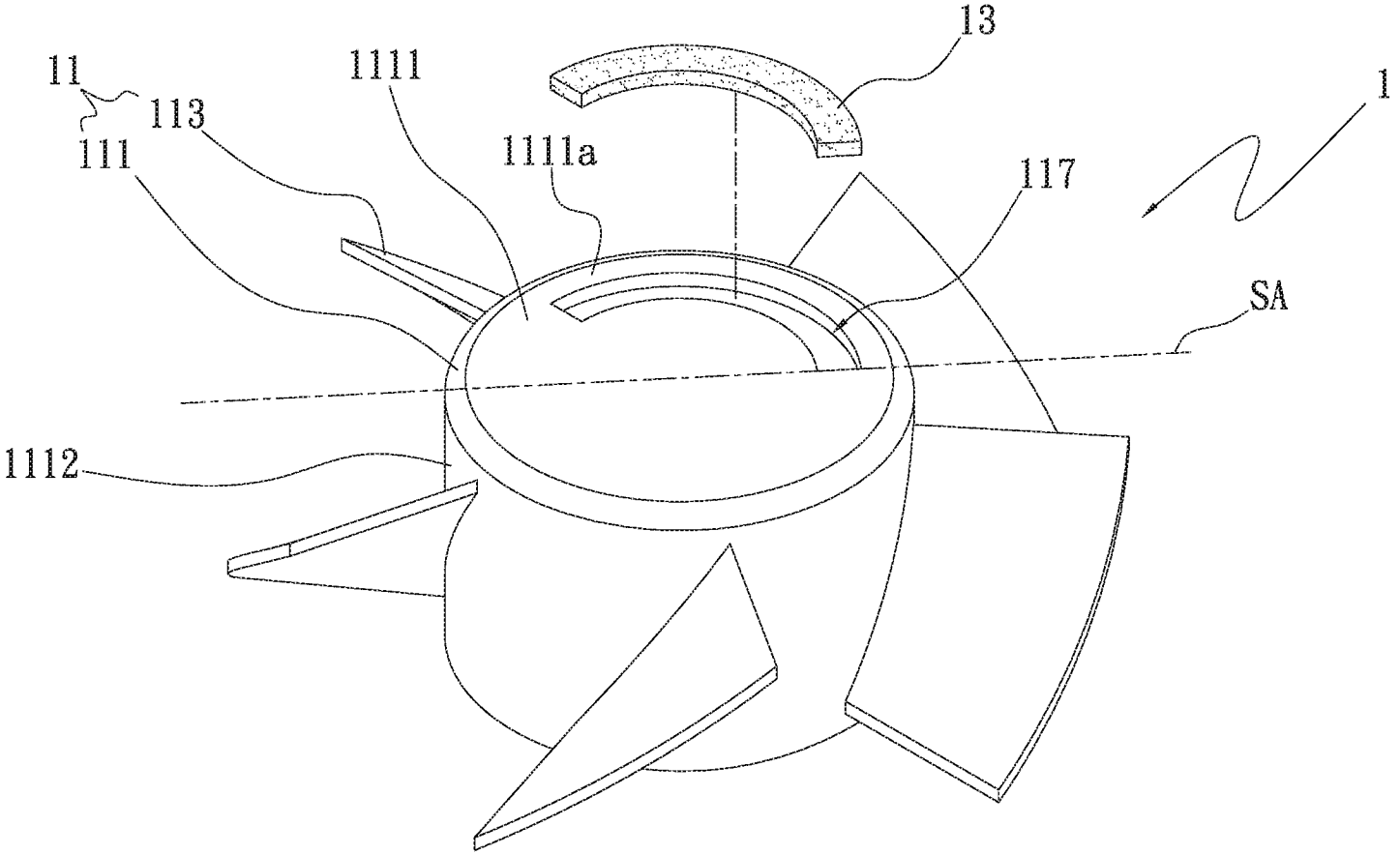
FIG. 3A is a perspective exploded view of the unbalanced portion of the rotor according to the second embodiment of the present invention.
Figure 3B:
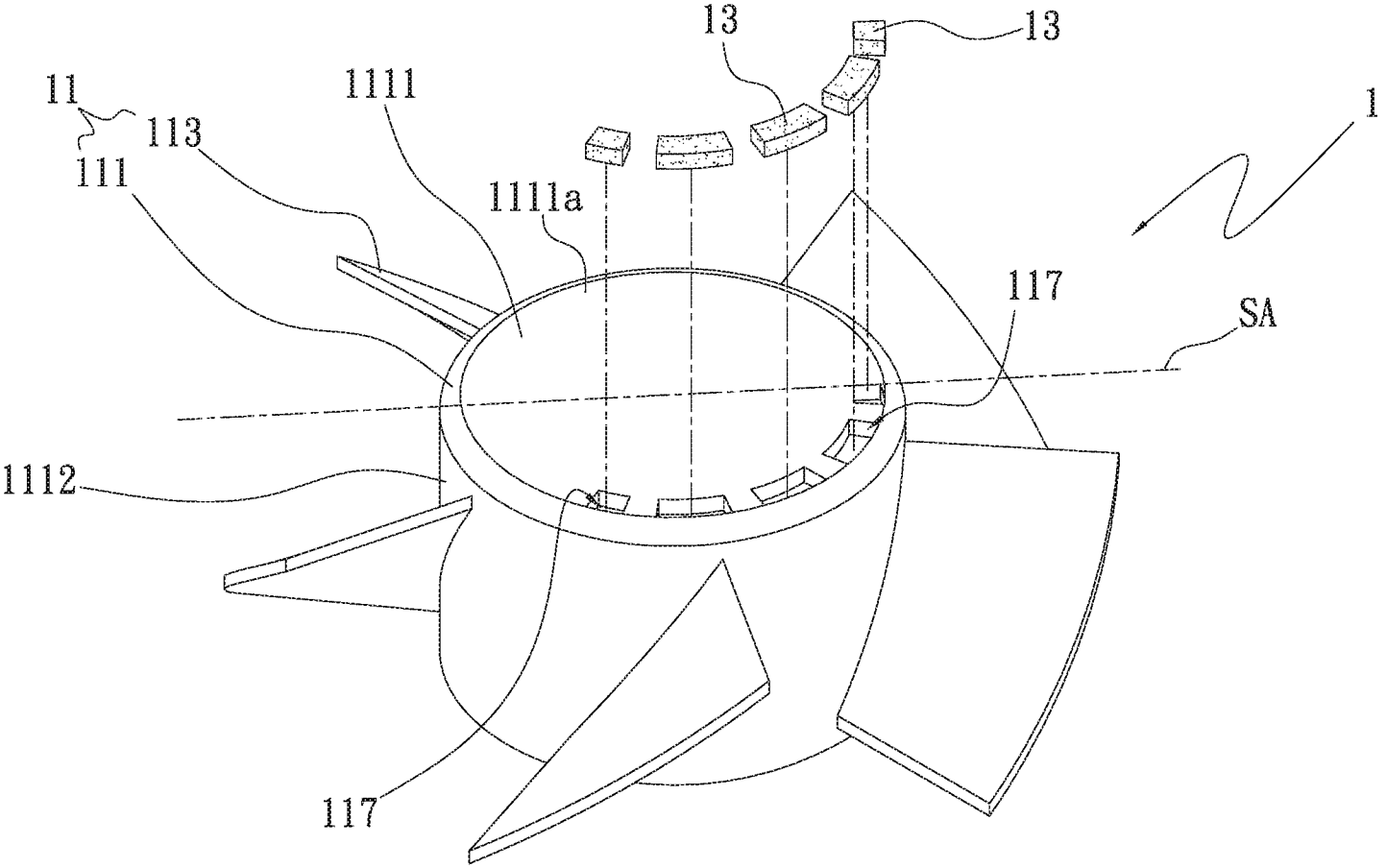
FIG. 3B is a perspective exploded view of the unbalanced portion of the rotor according to the third embodiment of the present invention.

In the second embodiment, referring to FIG. 3A, the unbalanced portion 117 is a recessed groove having a shape of half moon. In the third embodiment, referring to FIG. 3B, the unbalanced portion 117 is a recessed groove having a shape of honeycomb.

Figure 3C:
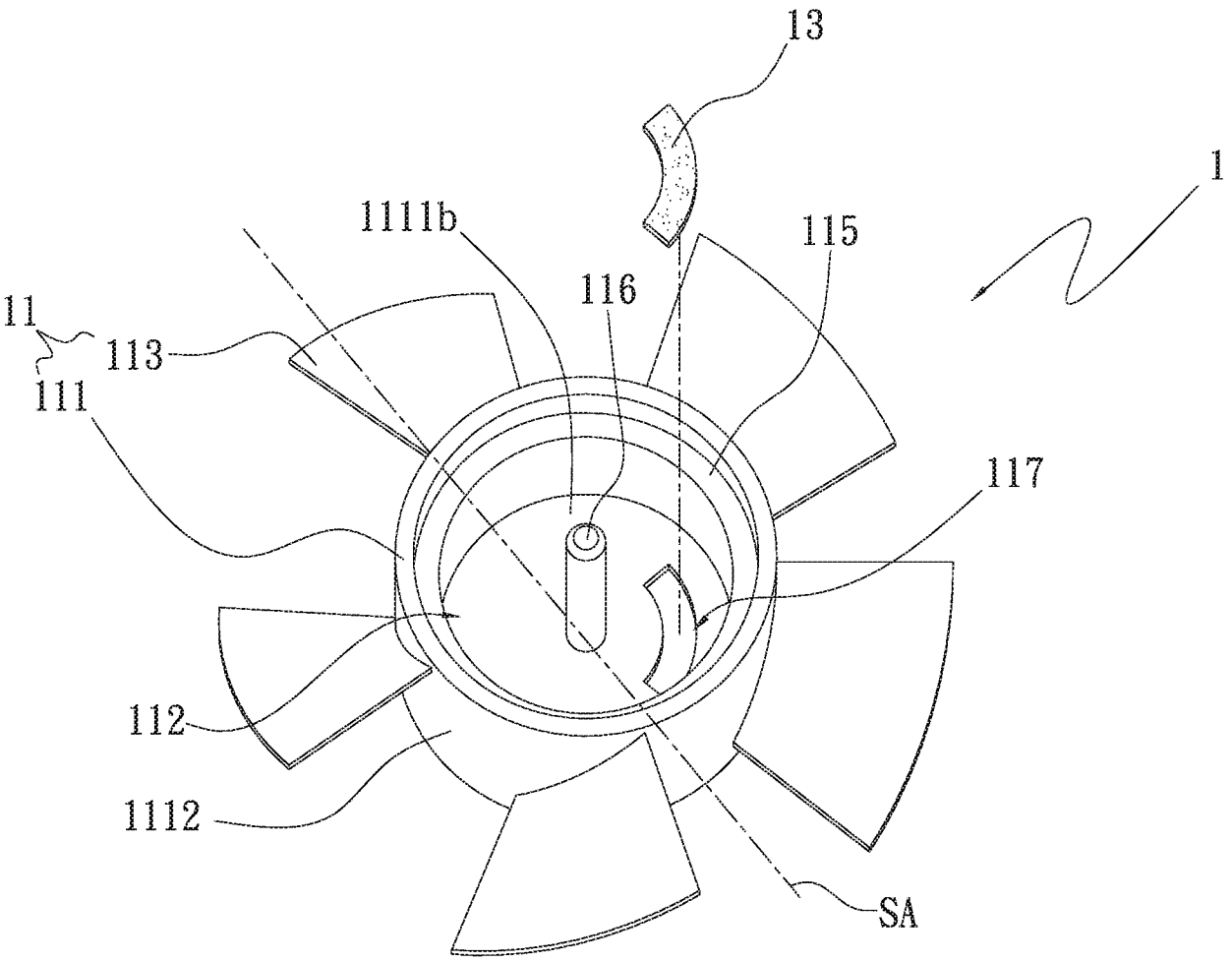
FIG. 3C is a perspective exploded view of the unbalanced portion of the rotor according to the fourth embodiment of the present invention.

In the fourth embodiment, referring to FIG. 3C, the design of the unbalanced portion 117 is changed to be a recessed groove having a shape of half moon (or arc) and is integrally formed and recessed on the internal surface 1111*b* of the top wall 1111 of the hub 111, located on one side of the symmetrical axis SA of the hub 111. The internal surface 1111*b* of the top wall 1111 of the hub 111 located on one side of the symmetrical axis SA of the hub 111 and the internal surface 1111*b* of the top wall 1111 of the hub 111 located on the other side of the symmetrical axis SA of the hub 111 are not symmetrical to each other.

Figure 4A:
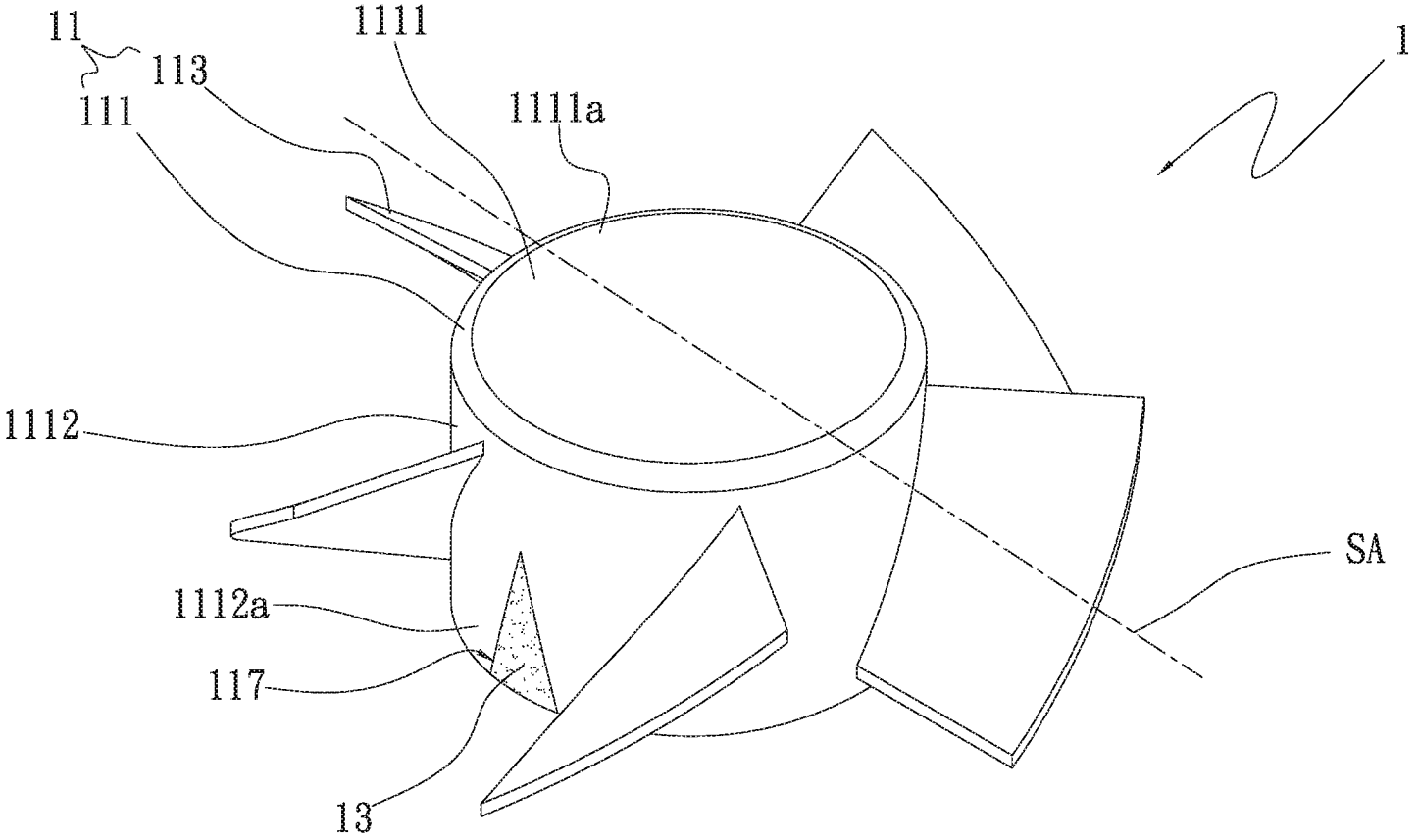
FIG. 4A is a perspective assembled view of the unbalanced portion of the rotor according to the fifth embodiment of the present invention.
Figure 4B:
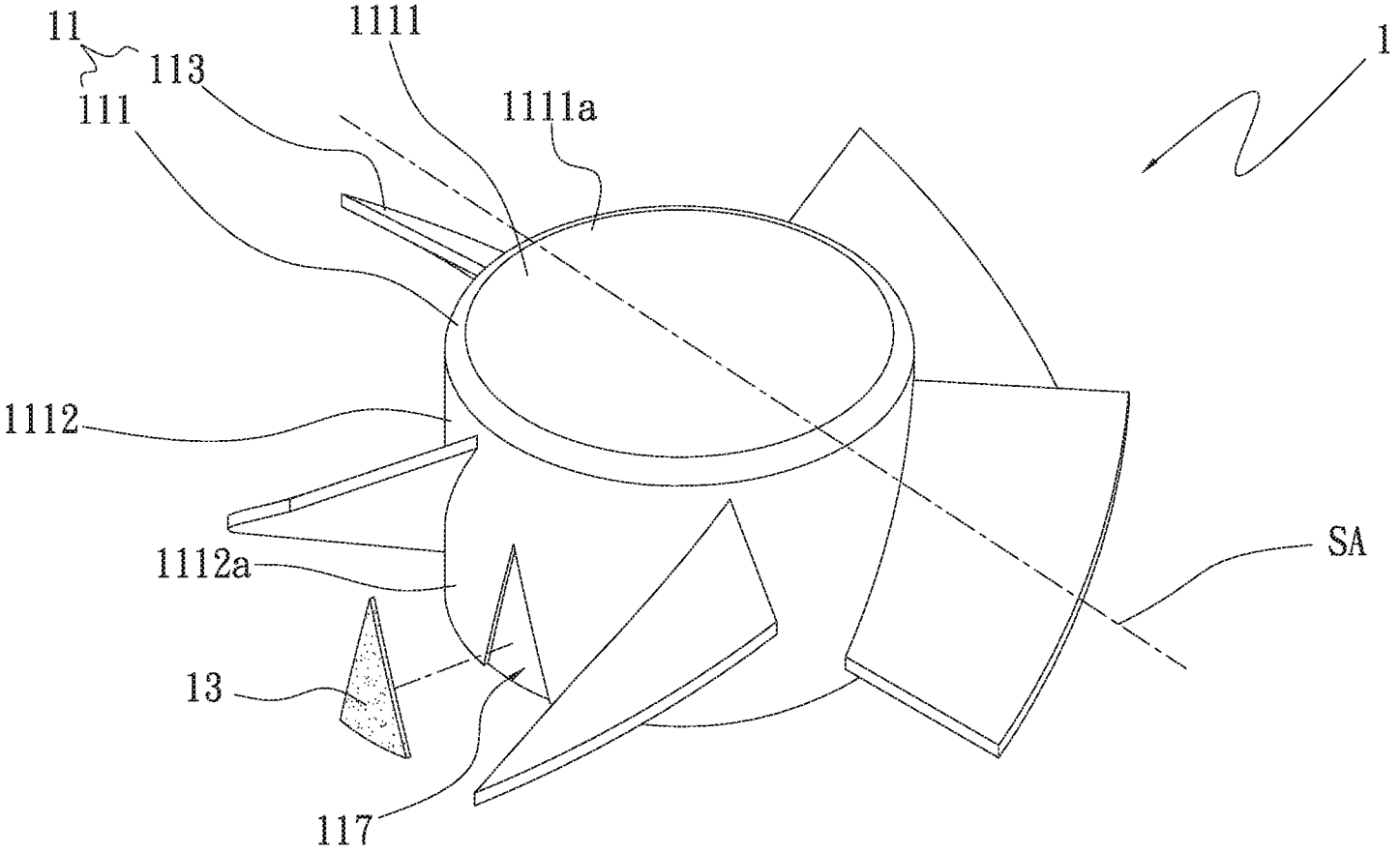
FIG. 4B is a perspective exploded view of the unbalanced portion of the rotor according to the fifth embodiment of the present invention.

Please continue to refer to FIG. 4A which is a perspective assembled view of the unbalanced portion of the rotor according to the fifth embodiment of the present invention and FIG. 4B which is a perspective exploded view of the unbalanced portion of the rotor according to the fifth embodiment of the present invention. As shown in FIGS. 4A and 4B, the unbalanced portion 117 of the present invention is a recessed groove having a shape of circular sector and is integrally formed and recessed on the external surface 1112*a* of the sidewall 1112 of the hub 111, located on one side of the symmetrical axis SA of the hub 111. The external surface 1112*a* of the sidewall 1112 of the hub 111 located on one side of the symmetrical axis SA of the hub 111 and the external surface 1112*a* of the sidewall 1112 of the hub 111 located on the other side of the symmetrical axis SA of the hub 111 are not symmetrical to each other. That is, the external surfaces 1112*a* of the sidewall 1112 of the hub 111 located on one side and on the other side of the symmetrical axis SA of the hub 111 indicate a non-symmetrical design. The symmetrical axis SA of the hub 111 is a virtual line that is vertical to the surface of the sidewall 1112 and passes through the center of the hub 111.

The balancing part 13 is disposed in the unbalanced portion 117 of the external surface 1112*a* of the sidewall 1112; the shape of the balancing part 13 matches that of the unbalanced portion 117. For example, the balancing part 13 having a circular sector shape can be directly placed in the corresponding circular sector shape formed in the unbalanced portion 117 such that the top side of the balancing part 13 is flush with the external surface 1112*a* of the sidewall 1112 of the hub 111 to achieve quick balancing of the fan rotor and reduce the working hours. The balancing process for the fifth embodiment is identical to that for the first embodiment and is not described here again. In the current embodiment, the unbalanced portion 117 is recessed on the external surface 1112*a* of the sidewall 1112 of the hub 111, injected and integrally formed through the above-mentioned injection mold and the balancing part 13 is placed in the unbalanced portion 117 to achieve the purpose of quick balancing and operating of the fan rotor.

Figure 4C:
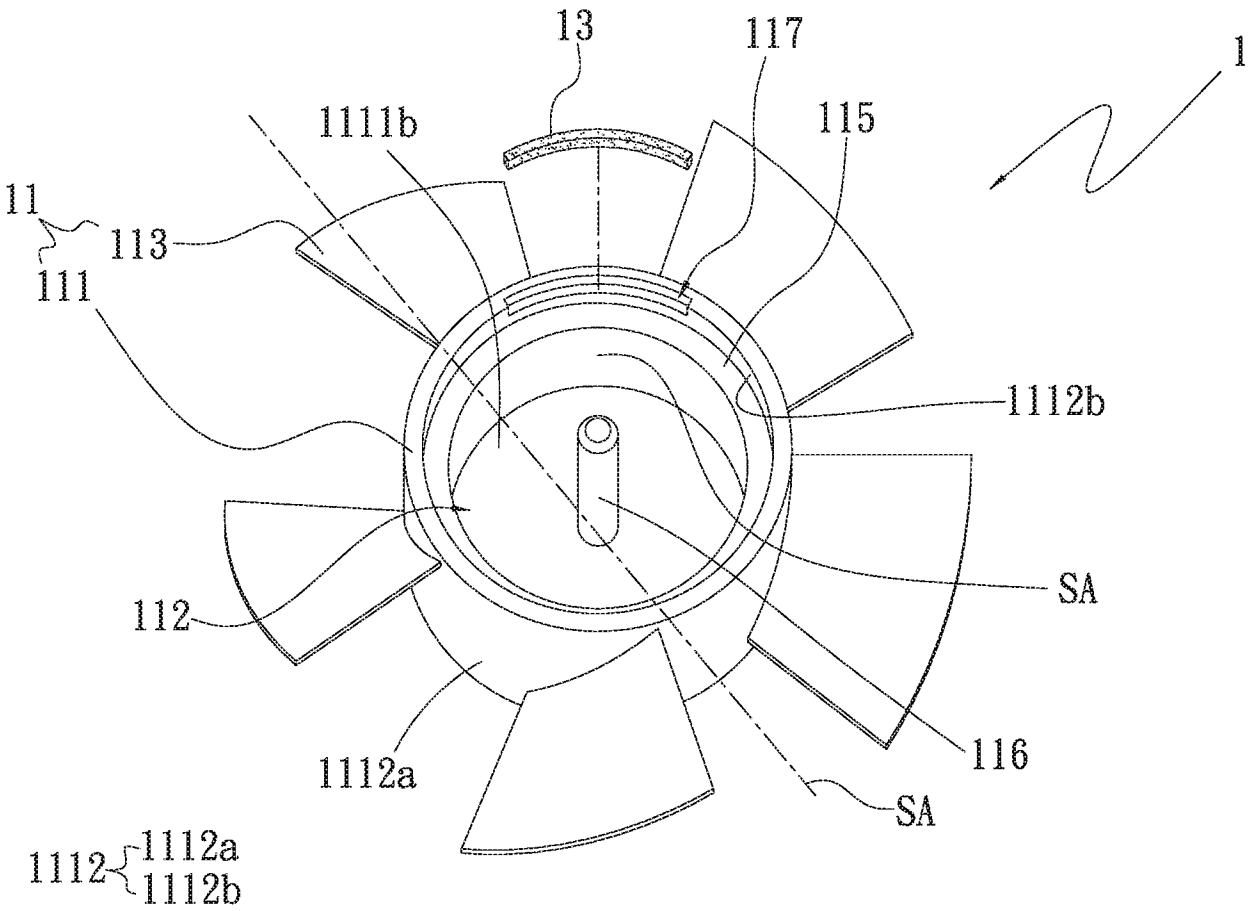
FIG. 4C is a perspective exploded view of the unbalanced portion of the rotor according to the sixth embodiment of the present invention.

In the sixth embodiment, referring to FIG. 4C, the design of the unbalanced portion 117 is changed to be a recessed groove shaped as a long strip and is integrally formed and recessed on the internal surface 1112*b* of the sidewall 1112 of the hub 111, located on one side of the symmetrical axis SA of the hub 111. The internal surface 1112*b* of the sidewall 1112 of the hub 111 located on one side of the symmetrical axis SA of the hub 111 and the internal surface 1112*b* of the sidewall 1112 of the hub 111 located on the other side of the symmetrical axis SA of the hub 111 are not symmetrical to each other.

Moreover, the shape of the recessed groove as the unbalanced portion 117 in the above embodiments is not limited to the shapes mentioned above. In practice, the recessed groove of the unbalanced portion 117 can be designed to have a shape of square, rectangle, circle, half moon, semicircle, honeycomb, circular sector, or one of other geometries.

What is claimed is:

1. A balance structure of a fan rotor comprising:

a fan wheel having a hub and a plurality of blades disposed on a circumferential side of the hub, wherein the hub has a top wall connected to a sidewall, wherein an unbalanced portion with an amount of reduction weight known in advance is selectively disposed on the top wall or on the sidewall, wherein the unbalanced portion is disposed on a single side of a symmetrical axis of the hub and a balancing part with an amount of compensation weight known in advance disposed at the unbalanced portion such that the fan rotor is balanced, wherein the amount of compensation weight of the balancing part corresponds to an unbalance weight of the hub and is equal to the amount of reduction weight of the unbalanced portion.

2. The balance structure of a fan rotor according to claim 1, wherein the unbalanced portion is integrally formed and recessed on an external surface of the top wall of the hub, wherein the external surface of the top wall of the hub located on one side of the symmetrical axis of the hub and the external surface of the top wall of the hub located on the other side of the symmetrical axis of the hub are not symmetrical to each other.

3. The balance structure of a fan rotor according to claim 1, wherein the unbalanced portion is integrally formed and recessed on an internal surface of the top wall of the hub, wherein the internal surface of the top wall of the hub located on one side of the symmetrical axis of the hub and the internal surface of the top wall of the hub located on the other side of the symmetrical axis of the hub are not symmetrical to each other.

4. The balance structure of a fan rotor according to claim 1, wherein the unbalanced portion is integrally formed and recessed on an external surface of the sidewall of the hub, wherein the external surface of the sidewall of the hub located on one side of the symmetrical axis of the hub and the external surface of the sidewall of the hub located on the other side of the symmetrical axis of the hub are not symmetrical to each other.

5. The balance structure of a fan rotor according to claim 1, wherein the unbalanced portion is integrally formed and recessed on an internal surface of the sidewall of the hub, wherein the internal surface of the sidewall of the hub located on one side of the symmetrical axis of the hub and the internal surface of the sidewall of the hub located on the other side of the symmetrical axis of the hub are not symmetrical to each other.

6. The balance structure of a fan rotor according to claim 1, wherein the balancing part is a balancing clay.

7. The balance structure of a fan rotor according to claim 1, wherein the unbalanced portion is a recessed groove.

8. The balance structure of a fan rotor according to claim 1, wherein the unbalanced portion has a shape of square, rectangle, circle, half moon, semicircle, honeycomb, or circular sector.

9. The balance structure of a fan rotor according to claim 1, wherein the symmetrical axis of the hub is a virtual line that is vertical to the surface of the sidewall and passes through the center of the hub.

10. The balance structure of a fan rotor according to claim 1, wherein a receiving space is defined by the top wall and the sidewall, wherein a magnetic part is received and disposed on an inner side of the sidewall of the receiving space, wherein an axial shaft is inserted to an inner side of the top wall of the hub.

* * * * *